US006397815B1

(12) United States Patent
von Werder

(10) Patent No.: US 6,397,815 B1
(45) Date of Patent: Jun. 4, 2002

(54) LOAD ADJUSTING DEVICE

(75) Inventor: Martin von Werder, Schwalbach (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/598,144

(22) Filed: Jun. 21, 2000

(30) Foreign Application Priority Data

Jun. 23, 1999 (DE) ..... 199 28 632

(51) Int. Cl.[7] ..... F02D 9/02; F02D 11/10
(52) U.S. Cl. ..... 123/396; 123/399
(58) Field of Search ..... 123/399, 396, 123/361, 690, 397, 398

(56) References Cited

U.S. PATENT DOCUMENTS 4,947,815 A * 8/1990 Peter ..... 123/399
5,036,813 A 8/1991 Pfalzgraf et al.
5,429,090 A * 7/1995 Kotchi et al. ..... 123/396
5,975,051 A * 11/1999 Yamada et al. ..... 123/396

FOREIGN PATENT DOCUMENTS

| | | |
|---|---|---|
| DE | 4108480 | 9/1992 |
| DE | 4141104 | 6/1993 |
| DE | 9409891 | 8/1994 |
| DE | 19548799 | 6/1996 |
| DE | 19725583 | 12/1998 |
| EP | 0378737 | 7/1990 |

* cited by examiner

*Primary Examiner*—Andrew M. Dolinar
*Assistant Examiner*—Arnold Casino
(74) *Attorney, Agent, or Firm*—Martin A. Farber

(57) ABSTRACT

A load adjusting device for a throttle (3) that determines the output of an internal combustion engine of a motor vehicle has an emergency-running spring (17) produced from an elastic material. A return spring (12) is configured as a steel spring and biases a lever (13) that is connected to the actuating shaft (2) via the emergency-running spring (17) against a stop (15) that is fixed to the housing. As a result, the load adjusting device is of particularly simple construction and can be produced cost-effectively.

11 Claims, 3 Drawing Sheets

LOAD ADJUSTING DEVICE

FIELD AND BACKGROUND OF THE INVENTION

The invention relates to a load adjusting device for an actuator that determines the output of an internal combustion engine of a motor vehicle, in particular an actuator designed as a throttle, and is arranged on an actuating shaft, having a reversible actuating drive for moving the actuating shaft between a minimum-load position and a full-load position, having a return spring for biasing the actuating shaft in the minimum-load direction and having an emergency-running spring for biasing the actuating shaft in the full-load direction into an emergency-running position defined by a stop.

A load adjusting device of the above-mentioned type is disclosed by EP 0 378 737 B1 (corresponding to U.S. Pat. No. 5,036,813). The reversible actuating drive of this load adjusting device has an electric motor for moving the actuator. In the event of failure of the actuating drive or of its control system, the actuator is forcibly moved into an emergency-running position by the emergency-running spring and the return spring. This emergency-running position is located between the minimum-load position and the full-load position. In this emergency-running position, the internal combustion engine generates an adequately high torque to move the motor vehicle at a low speed out of a hazardous area. The emergency-running spring and the return spring are in this case each configured as steel springs, the spring force of the emergency-running spring being at least as great as the spring force on the return spring. The drawback with the known load adjusting device is that it is of very complicated construction and is costly to produce. Furthermore, mutually opposed steel springs can set the actuating shaft oscillating and, by this means, make it more difficult to define the emergency-running position exactly.

SUMMARY OF THE INVENTION

The invention is based on the problem of configuring a load adjusting device of the type mentioned at the beginning in such a way that it is particularly cost-effective to produce and that the emergency-running position can be defined particularly accurately.

According to the invention, this problem is achieved by the emergency-running spring being produced from an elastic polymer.

As a result of this formation, the emergency-running spring- has inherent damping, so that oscillation of the actuating shaft is reliably prevented. The emergency-running position may therefore be defined simply and is reached reliably in the event of failure of the actuating drive. Furthermore, the emergency-running spring damps shocks on the actuating shaft caused by the stop and therefore leads to low bearing wear of the actuating shaft. Oscillations of the actuator brought about by pressure fluctuations in the intake pipe of the internal combustion engine, and therefore oscillations of the actuating shaft, are likewise damped by the emergency-running spring. As compared with the steel springs of the known load adjusting device, the emergency-running spring can be produced very cost-effectively. This leads to a reduction in the production costs of the load adjusting device according to the invention. The elastic polymer may be, for example, a rubber.

The load adjusting device according to the invention has a particularly compact configuration if the emergency-running spring is arranged between the actuating shaft and a lever that can be moved by the return spring against the stop of the emergency-running position.

The load adjusting device according to the invention can be tuned: particularly simply if the actuating shaft has a direct operative connection to an actuating mechanism of the actuating drive. As a result of this configuration, the ratio of the spring forces is immaterial for the definition of the emergency-running position, since in the position of the lever in which the latter rests against the stop, the emergency-running position is determined only by the emergency-running spring. Between the emergency-running position and the full-load position, the emergency-running spring and the return spring are arranged one behind an other. Therefore, complicated matching of the emergency-running spring with respect to the return spring is not required.

The load adjusting device according to the invention can be designed particularly simply if the lever has a sleeve that surrounds the actuating shaft concentrically.

According to an advantageous development of the invention, the emergency-running spring is configured to guide and hold the sleeve with the stop if the emergency-running spring is shaped like a ring surrounding the actuating shaft. By this means, the load adjusting device according to the invention has particularly few components, which leads to a further reduction in its production costs.

According to another advantageous development of the invention, the spring characteristic of the emergency-running spring can be set simply if the ring-shaped emergency-running spring has recesses. The ratio between the size of the recesses and the mass and the arrangement of the elastic polymer in this case determine the spring characteristic of the emergency-running spring.

The load adjusting device according to the invention can be assembled particularly simply if the emergency-running spring is integrally connected to the sleeve and to a bush that is fixed to the actuating shaft so as to rotate with it. By this means, the emergency-running spring, together with adjacent components, forms a preassembled structural unit. This structural unit may subsequently be mounted simply in its envisaged position on the shaft. At the same time, the emergency-running position of the actuating shaft with the lever resting on the stop can additionally be set simply.

According to another advantageous development of the invention, the emergency-running position can subsequently be set simply if a rotation angle between the bush and the actuating shaft can be set.

A further contribution to reducing the production costs of the load adjusting device according to the invention is made if the lever and the sleeve are produced in one piece from a polymer.

According to another advantageous development of the invention, an envisaged spring force of the emergency-running spring in the emergency-running position can be ensured simply if the sleeve or the bush has a biasing lever for biasing the emergency-running spring and if, when it is in the emergency-running position, the biasing lever is biased against the stop on the respective other component.

According to another advantageous development of the invention, setting the spring force of the emergency-running spring in the emergency-running position can be done particularly simply if the sleeve has a protrusion, the stop being arranged on one side of the protrusion, and a ramp being arranged on the side opposite the stop. Furthermore, as a result of its arrangement on the sleeve, the projection has large dimensions and therefore a high stability.

BRIEF DESCRIPTION OF THE DRAWINGS

The invention permits numerous embodiments. In order to illustrate its basic principle further, two of these embodiments are illustrated in the drawings and will be described below. In the drawings

DETAILED DESCRIPTION OF THE PREFERRED EMBODIMENTS

Figure 1:
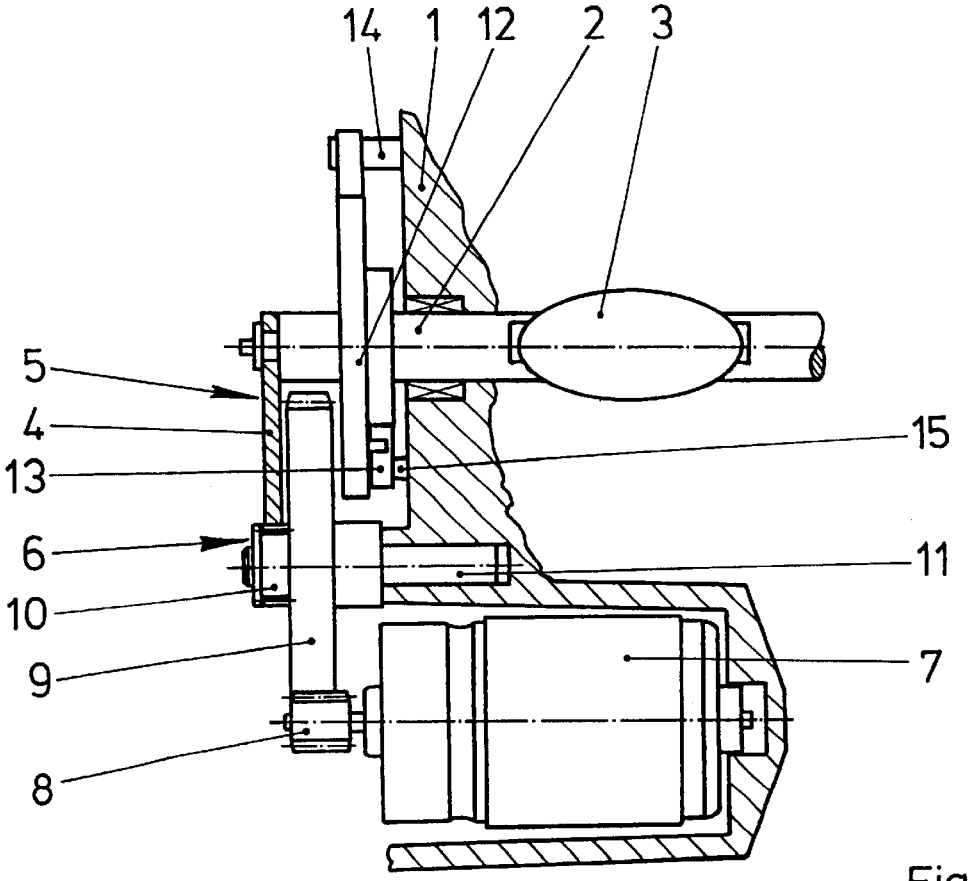
FIG. 1 shows a sectional representation of a load adjusting device-according to the invention.

FIG. 1 shows a subarea of a housing 1 of a throttle connecting piece of a load adjusting device provided for controlling the output of an internal combustion engine (not illustrated). Mounted in the housing 1 is an actuating shaft 2, which is designed as a throttle shaft and on which there is arranged a throttle flap 3 (illustrated schematically). Seated on the actuating shaft 2 so as to rotate with it is an actuating part 5 which has a toothed segment 4 and which can be pivoted by means of an actuating mechanism 6.

The actuating mechanism 6 has an actuating motor 7, which drives a large-diameter intermediate gear wheel 9 via a drive pinion 8. This intermediate gear wheel 9 is produced in one piece with a small-diameter gear wheel 10 and mounted on an axle 11. The actuating part 5 having the toothed segment 4 is permanently engaged with the gear wheel 10 arranged on the intermediate gear wheel 9. In addition, the throttle connecting piece has a return spring 12 designed as a torsion spring. One end of the return spring 12 is attached to a lever 13 connected to the actuating shaft 2, while the other end is supported on a stop 14 fixed to the housing. In addition, a stop 15 for the lever 13 that is connected to the actuating shaft 2 is arranged on the housing 1.

Figure 2:
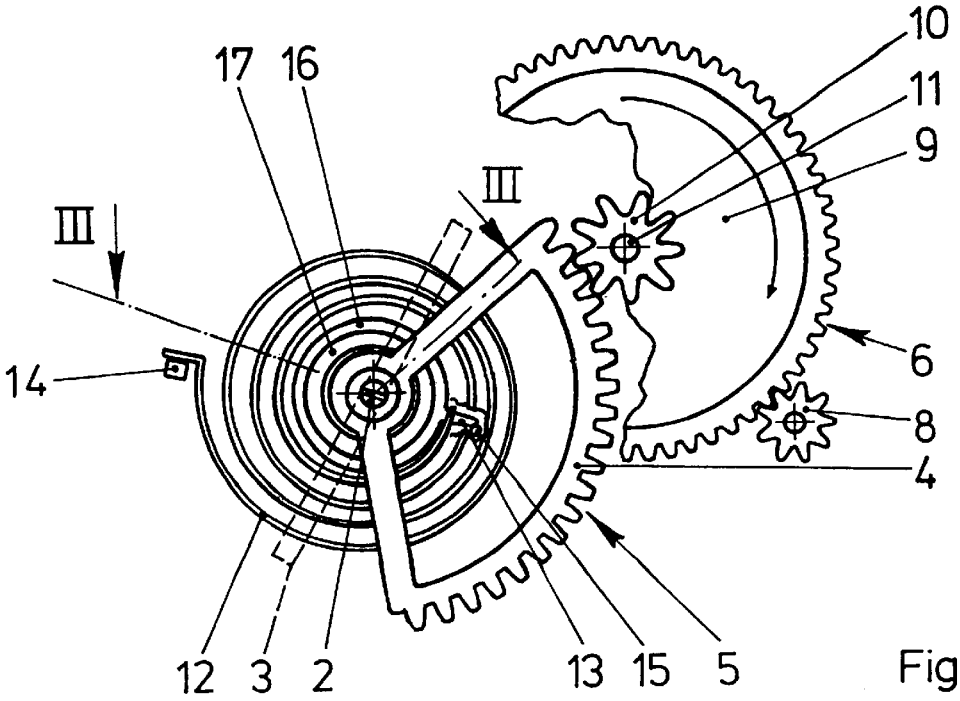
FIG. 2 shows a partly sectioned side view of the load adjusting device from FIG. 1 in the emergency-running position.

FIG. 2 shows, in a partly sectioned view, a view of the throttle connecting piece from FIG. 1, at right angles to the actuating mechanism 6. In this case, it can be seen that the lever 13 connected to the actuating shaft 2 is arranged on a sleeve 16. Fixed on the inside of the sleeve 16 is a ring-shaped emergency-running spring 17 produced from an elastic polymer. In FIG. 2, the throttle connecting piece is represented in an emergency-running position, in which the actuating motor 7 represented in FIG. 1 is de-energized, and the emergency-running spring 17 and the return spring 12 bias the throttle 3 into the position drawn. If the large-diameter intermediate gear wheel 9 is rotated in the clockwise direction, the actuating part 5 arranged on the actuating shaft 2 so as to rotate with it is moved in the counterclockwise direction and, in so doing, tensions the return spring 12, until the throttle 3 reaches a full-load position. If, starting from the emergency-running position drawn, the actuating part 5 is moved in the clockwise direction, the actuating shaft 2 is rotated with respect to the sleeve 16. At the same time the sleeve 16 remains in the rotary position defined by the lever 13 on the stop 15 fixed to the housing. The rotation of the actuating shaft 2 with respect to the sleeve 16 means that the emergency-running spring 17 is rotated.

Figure 3:
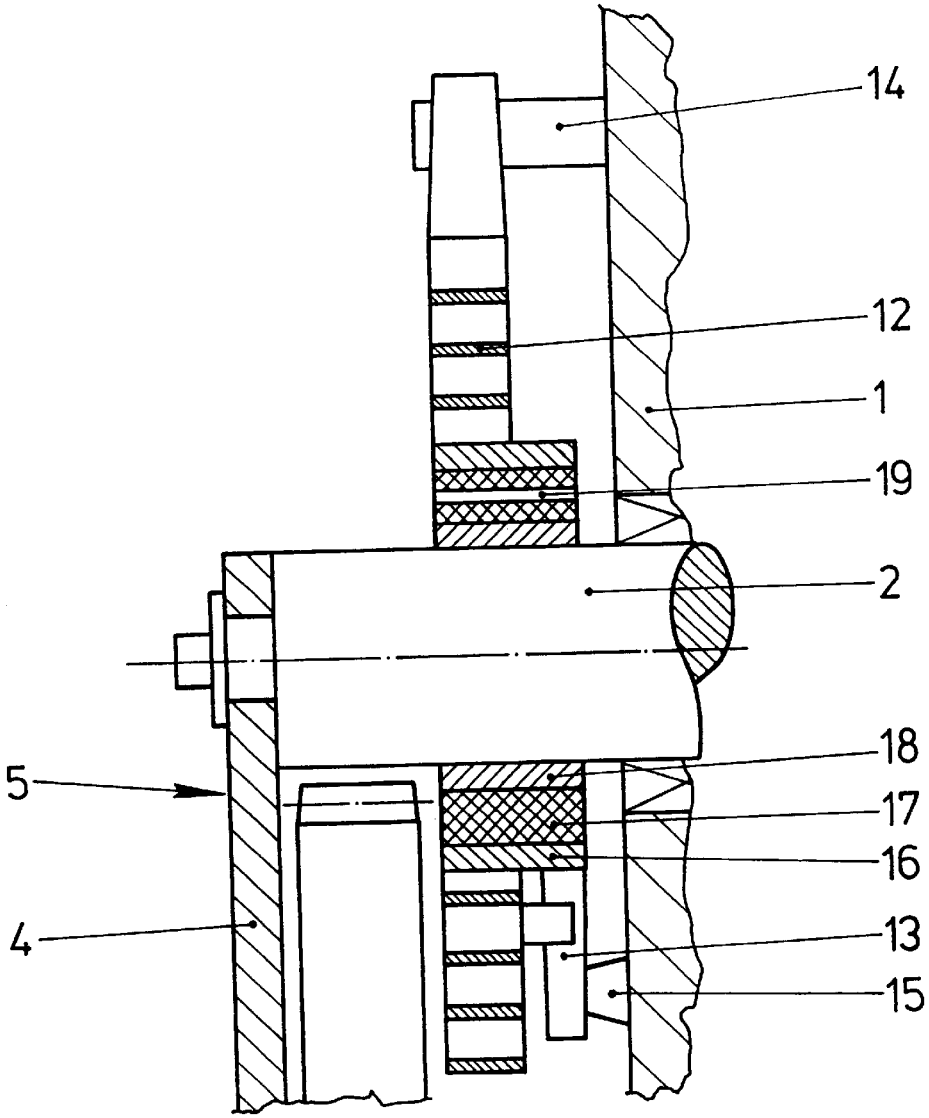
FIG. 3 shows a much enlarged sectional representation through a subarea of the load adjusting device from FIG. 2 along the line III—III and, FIG. 4 shows a perspective representation of an emergency-running spring of a further embodiment of the load adjusting device according to the invention.

FIG. 3 shows, in a much enlarged sectional representation, a section through a subarea of the actuating shaft 2 which accommodates the emergency-running spring 17. The emergency-running spring 17, which is produced from an elastic polymer, is integrally fixed on a bush 18. The bush 18 is permanently welded to the actuating shaft 2 in an envisaged rotary position, in which the throttle 3 represented in FIGS. 1 and 2 is located in the envisaged position. Of course, the bush 18 can also have a multiplicity of internal teeth and be plugged onto a correspondingly configured multiplicity of external teeth on the actuating shaft 2. The emergency-running spring 17 has a recess 19 in order to produce an envisaged spring characteristic.

Figure 4:
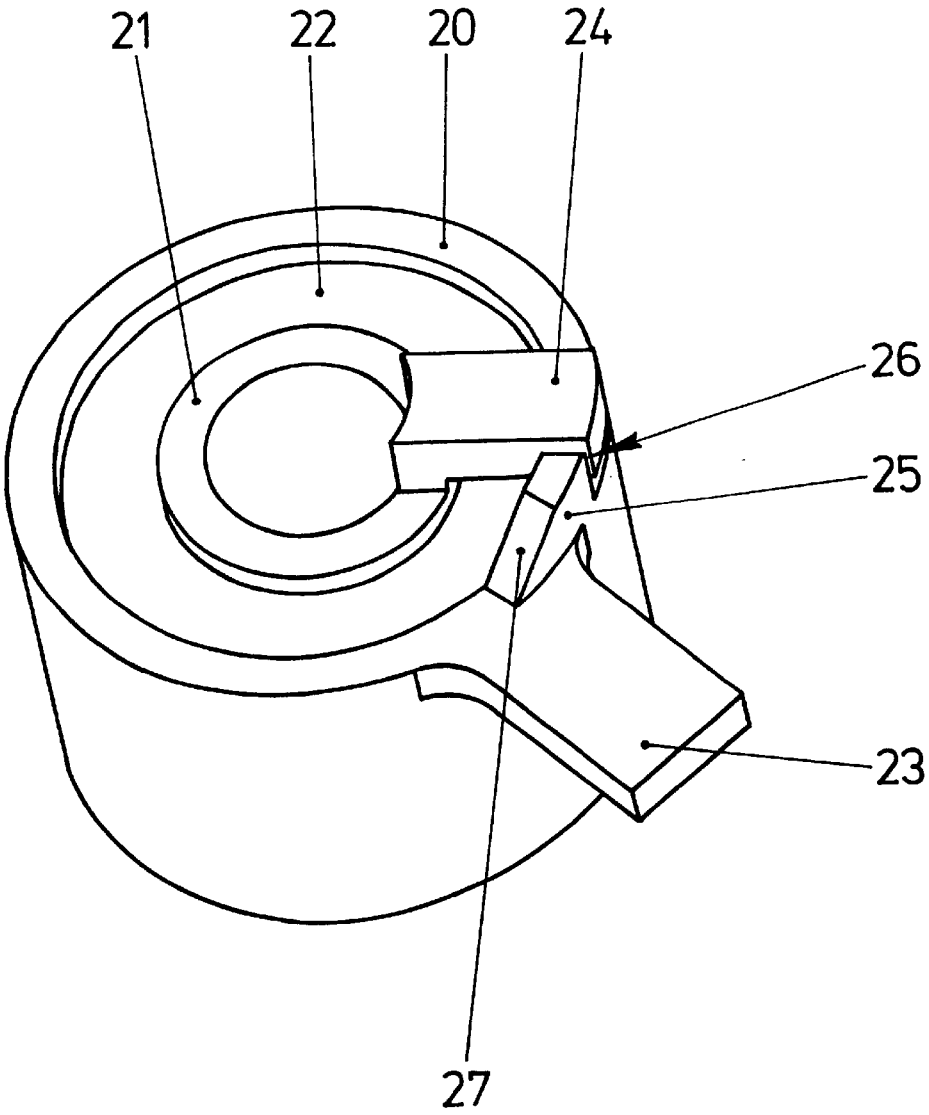

FIG. 4 shows, in perspective form, an emergency-running spring 22 which is produced from an elastic polymer and is arranged between a sleeve 20 and a bush 21. The sleeve 20 and the bush 21 are used, as in FIG. 3, for transmitting a torque to the actuating shaft 2 that is connected to the bush 21 so as to rotate with it. The sleeve 20 has a lever 23 for the attachment of the return spring 12 represented in FIG. 3. Arranged on the bush 21 is a biasing lever 24. The sleeve 20 has a protrusion 25 with a stop 26, against which the biasing lever 24 is biased. This identifies the emergency-running position. If the actuating shaft 2 represented in FIG. 1 is moved in the direction of the minimum-load position, the biasing lever 24 is moved away from the stop 26. In order to make it easier for the biasing lever 24 to move from the unbiased position in front of the protrusion 25 into the biased position drawn, the protrusion 25 has a ramp 27.

I claim:

1. A load adjusting device for an actuator that determines the output of an internal combustion engine of a motor vehicle, in particular an actuator formed as a throttle, and is arranged on an actuating shaft, having a reversible actuating drive for moving the actuating shaft between a minimum-load position and a full-load position, having a return spring for biasing the actuating shaft in the minimum-load direction and having an emergency-running spring for biasing the actuating shaft in the full-load direction into an emergency-running position defined by a stop, wherein the emergency-running spring (17, 22) is produced from an elastic polymer.

2. The load adjusting device as claimed in claim 1, wherein said emergency-running spring (17, 22) is arranged between the actuating shaft (2) and a lever (13, 23) that can be moved by the return spring (12) against the stop (15) of the emergency-running position.

3. The load adjusting device as claimed in claim 1, wherein the actuating shaft (2) has a direct operative connection to an actuating mechanism (6) of the actuating drive.

4. A load adjusting device for an actuator that determines the output of an internal combustion engine of a motor vehicle, in particular an actuator formed as a throttle, and is arranged on an actuating shaft, having a reversible actuating drive for moving the actuating shaft between a minimum-load position and a full-load position, having a return spring for biasing the actuating shaft in the minimum-load direction and having an emergency-running spring for biasing the actuating shaft in the full-load direction into an emergency-running position defined by a stop, wherein the emergency-running spring (17, 22) is produced from an elastic polymer, wherein said emergency-running spring (17, 22) is arranged between the actuating shaft (2) and a lever (13, 23) that can be moved by the return spring (12) against the stop (15) of the emergency-running position and wherein the lever (13, 23) has a sleeve (16, 20) that surrounds the actuating shaft (2) concentrically.

5. A load adjusting device for an actuator that determines the output of an internal combustion engine of a motor vehicle, in particular an actuator formed as a throttle, and is arranged on an actuating shaft, having a reversible actuating drive for moving the actuating shaft between a minimum-load position and a full-load position, having a return spring for biasing the actuating shaft in the minimum-load direction and having an emergency-running spring for biasing the actuating shaft in the full-load direction into an emergency-running position defined by a stop, wherein the emergency-running spring (17, 22) is produced from an elastic polymer and wherein the emergency-running spring (17, 22) is substantially ring-shaped surrounding the actuating shaft (2).

6. The load adjusting device as claimed in claim 5, wherein the ring-shaped, emergency-running spring (17) has recesses (19).

7. The load adjusting device as claimed in claim 4, wherein the emergency-running spring (17, 22) is integrally connected to the sleeve (16, 20) and to a bush (18, 21) that is fixed to the actuating shaft (2) so as to rotate therewith.

8. The load adjusting device as claimed in claim 7, wherein a rotary angle between the bush (18, 21) and the actuating shaft (2) is settable.

9. The load adjusting device as claimed in claim 4 wherein the lever (13, 23) and the sleeve (16, 20) are constituted in one piece from a polymer.

10. The load adjusting device as claimed in claim 7, wherein the sleeve (20) or the bush (21) has a biasing lever (24) for biasing the emergency-running spring (22), and wherein, when it is in the emergency-running position, the biasing lever (24) is biased against a stop (26) of a respective other component.

11. The load adjusting device as claimed in claim 10, wherein the sleeve (20) has a protrusion (25), the stop (26) being arranged on one side of the protrusion (25), and a ramp (27) being arranged on a side opposite the stop (26).

* * * * *